United States Patent [19]

Coleman et al.

[11] 4,002,280

[45] Jan. 11, 1977

[54] FILM TRANSPORT APPARATUS UTILIZING ROLLERS TO PROVIDE A U-PATH

[75] Inventors: Kenneth R. Coleman, Warren; Hans G. Steinebach, Hackensack; H. Werner Waden, Paramus; Paul Zamek, Westwood, all of N.J.

[73] Assignee: Colenta American Corporation, Paramus, N.J.

[22] Filed: May 12, 1976

[21] Appl. No.: 685,761

[52] U.S. Cl. ..... 226/171; 226/189; 354/319

[51] Int. Cl.[2] ..... B65H 17/22

[58] Field of Search ..... 226/189, 196, 91, 171; 354/319, 320, 322

[56] References Cited

UNITED STATES PATENTS

| | | | |
|---|---|---|---|
| 3,366,025 | 1/1968 | Layne | 226/189 X |
| 3,779,439 | 12/1973 | Fessop | 226/196 X |

*Primary Examiner*—Richard A. Schacher
*Attorney, Agent, or Firm*—Ralph R. Roberts

[57] ABSTRACT

This invention provides a U-shaped pathway for cut film and prints as the cut sheets are automatically moved in a prescribed manner, path and speed through a processing tank or tanks. This transport is between rollers which are spaced from each other sufficiently so that any potential squeezing or pressing on the emulsion surface of the film is safely absent. Large rollers are arranged in three vertical columns and provide the down and up travel path of the film. At the bottom of this transport path a large roller provides an inside guide for the film. A series of small rollers provide an outer guide path for the U-shaped transport section of film. These small rollers are driven as are all the other rollers but this outer U-guide is formed of short rollers arranged in an intermeshed pattern to provide a closely guided contour. Short small rollers are carried in spaced array on common shafts. Like sized rollers in a like spaced array on an adjacent shaft are mounted so as to fill the provided spaces between the rollers so that in intermeshed arrangement the driving contact surfaces provided by the rollers are spaced approximately one-half the diameter of the small rollers.

17 Claims, 8 Drawing Figures

FILM TRANSPORT APPARATUS UTILIZING ROLLERS TO PROVIDE A U-PATH

BACKGROUND OF THE INVENTION

1. Field of the Invention

With reference to the classification of art as established by the United States Patent Trademark Office the present invention is believed to be found in the general Class entitled, "Advancing Material of Indeterminate Length" (Class 226) and in the subclass thereunder entitled, "static guide" (subclass 196) and in the general Class entitled, "Photograph" (Class 354) and the subclass entitled, "fluid-treating apparatus — with film immersed and removed" (subclass 319).

2. Description of the Prior Art Attempts

The developing of photographic film, both positive and negative, is an old and complex art. The improvements in the speed and color of films have made the close control of bath, speed and contact with the emulsion more critical with each advance in the film art. Many of the present films have soft, easily scratched emulsions particularly when immersed in developing solutions. Attemps to provide high speed, automatically and closely controlled roller transporting devices for film are many. Usually in addition to a spaced set of rollers there is provided outer curved guide members. Such a showing is found in U.S. Pat. No. 3,785,543 to LEE as issued on Jan. 15th, 1974. The prior art also discloses the use of belts and curved guides to insure the U-turn transporting of film through processing tanks.

In the present invention there is provided rollers which are offset from one another and are spaced so that a serpentine path for transporting the film is provided. The film to be transported, whether a positive or negative film, is contemplated to have enough residual stiffness in its base structure so that when bent from a normal flat plane the bent film will engage the periphery of the rollers sufficiently for the turning rollers to move the film forward.

SUMMARY OF THE INVENTION

This invention may be summarized at least in part with reference to its objects.

It is an object of this invention to provide, and it does provide, a film transport apparatus for automatically advancing film in a U-path through a processing tank in which the outer guideway of the U-turn is provided by a series of intermeshed roller assemblies driven in the same direction. These assemblies have a multiplicity of small rollers carried in a spaced array on common shafts. These rollers are of a like size and are so intermeshed that the film driving contact surfaces of the spaced rollers are at approximately one-half the diameter of the smaller rollers.

It is another object of this invention to provide, and it does provide, for a U-shaped pathway of a film transport apparatus in which the vertical transport is between rollers which are spaced and positioned from each other sufficiently so that the film is moved in a serpentine film transport path. These rollers providing the vertical transport are spaced to provide at least a one-eighth inch clearance between the driving surfaces of the rollers so that no squeeze or abrading of the wet film surface occurs. At the bottom of the vertical up and down film transport there is provided a U-shaped transport in which the inner pathway is provided by a larger turning roller. The outer pathway is provided by short small rollers carried as roller assemblies in a spaced array on common shafts. Like sized rollers in similar shaft assemblies and in the same spaced array are provided on other shafts and occupy the spaces between the rollers of the adjacent assembly. When the rollers are intermeshed in a driving arrangement the film driving contact surfaces of the small rollers engage the film at approximately one-half the diameter of the small rollers. The small rollers are at least one-sixteenth of an inch from the periphery of the larger turning roller so that the transported film is not squeezed or abraded during its flow and transport.

In brief, this film processing tank is closed except at its top and within this tank and the fluid there are carried a series of vertical rollers which in the embodiment shown are three rows of vertical rollers. The outer row of rollers is spaced approximately halfway in between the intermediate or central rollers. The outer rollers are so spaced that their distance from the axis of the intermediate or central row of rollers is approximately equal. The outer rollers are brought into the spacing between the intermediate or central rollers so that a serpentine path is provided. This serpentine path is disposed between the vertical rows of rollers so that a space of approximately one-eighth of an inch between film contacting surfaces is provided between the peripheries of the rollers.

At the bottom of these vertical rollers is a large center roller which provides the inner guide for a U-turn of the film and for the outer turn of the film there is a series of small rollers with each of the rollers carried in a spaced array and in an intermeshed path pattern to provide a closely guided U-shaped contour. Small rollers of like diameter and of short length are carried in a spaced array on a common shaft. Like sized rollers in the same spaced array are mounted on other shafts and are carried so as to fill the spaces provided by the rollers as arranged in the adjacent roller assemblies. In this intermeshed arrangement driving contact surfaces from like sized rollers are provided on the same shaft. The spaces between rollers are so arranged that the rollers of one shaft fit into the space of the next or adjacent shaft assembly of small rollers to provide an intermeshed driving arrangement. In this arrangement the driving contact surfaces provided by the series of small rollers are approximately one-half the diameter of the small rollers.

In addition to the above summary the following disclosure is detailed to insure adequacy and aid in understanding of the invention. This disclosure, however, is not intended to prejudice that purpose of a patent which is to cover each new inventive concept no matter how it may be disguished by variations in form or additions of further improvements. For this reason there has been chosen a specific embodiment of the film transport apparatus as adopted for providing U-shaped guide paths and showing a preferred means for a U-shaped end transport provided by intermeshed small rollers. This specific embodiment and alternate embodiments thereof have been chosen for the purposes of illustration and description as shown in the accompanying drawings wherein:

BRIEF DESCRIPTION OF THE DRAWINGS

In the following description and in the claims various details will be identified by specific names for convenience; these names, however, are intended to be generic in their application. Corresponding reference characters refer to like members throughout the eight figures of the drawings.

The drawings accompanying and forming part of this specification disclose certain details of construction for the purpose of explanation of the invention, but it should be understood that such details may be modified and incorporated in other structural forms than shown.

DESCRIPTION OF THE PREFERRED EMBODIMENT

Figure 1:
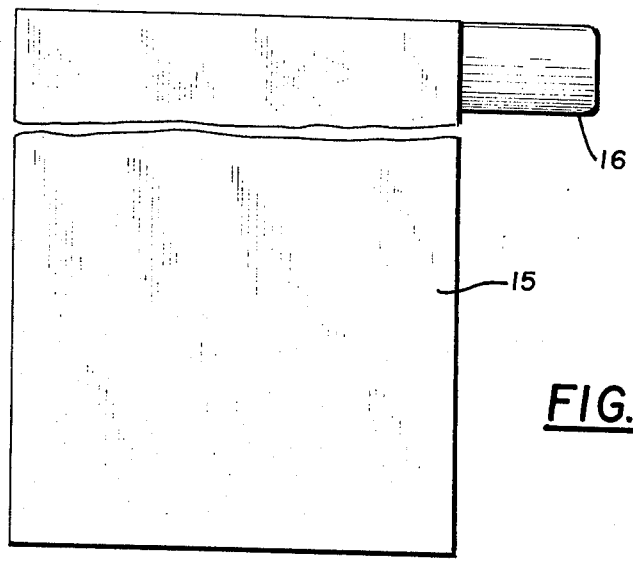
FIG. 1 represents a side view of a film processing tank in which the U-path of a positively transported film is controlled as to speed and engagement with the surface of the film.

Referring now to the drawings and in particular to FIG. 1, it is to be noted that an outer tank 15 carries on its side a motor 16 adapted to drive one of the rollers providing the vertical film transport. This motor may be secured to the side of the tank 15 to drive an upper middle roller providing a portion of the transport of the film.

Figure 3:
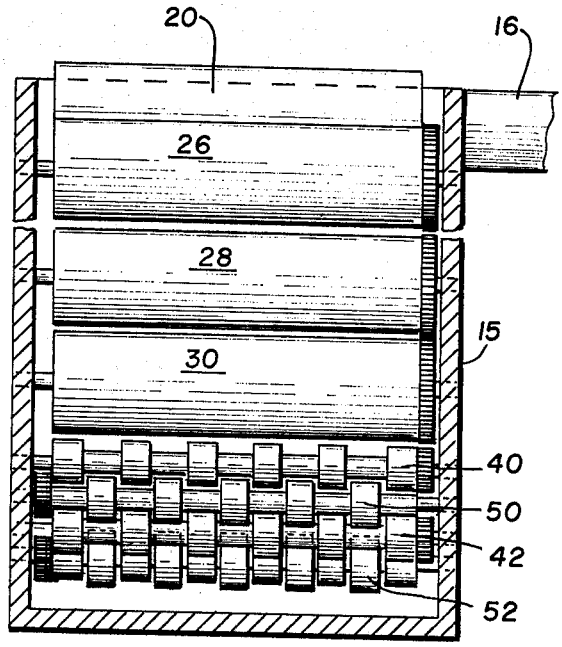
FIG. 3 represents a side view, partly diagrammatic and fragmentary, of the roller arrangement of FIG. 2, this view taken on the line 3—3 thereof and looking in the direction of the arrows.
Figure 2:
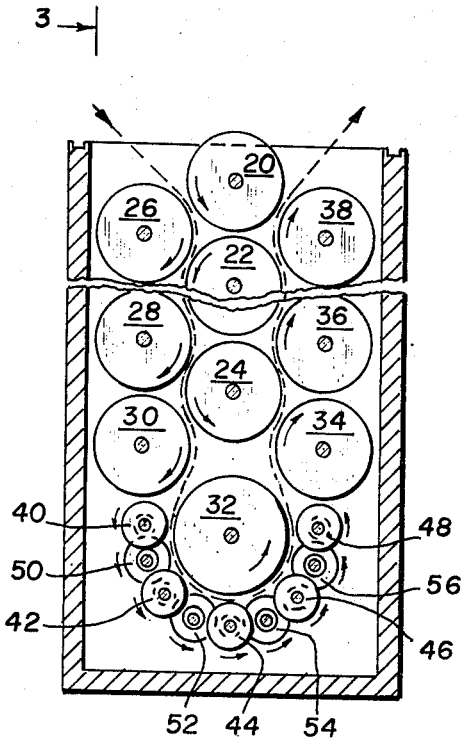
FIG. 2 represents an end view, partly diagrammatic, of the roller arrangement providing the U-path of the film through the processing tank.

Referring now in particular to FIGS. 2 and 3, as depicted, there is a series of large intermediate rollers which for the sake of identification are numbered 20, 22 and 24. As seen in FIG. 2, these rollers turn in the counterclockwise direction and the axes of these rollers are preferably on a common vertical plane. These rollers are spaced so that they are not in surface contact with one another. To the left of these intermediate rollers 20, 22 and 24 are a like number and like sized larger rollers which for the sake of identification are numbered 26, 28 and 30. These left rollers with the intermediate rollers provide the down film path. These left rollers turn in a clockwise direction and their axes are contemplated as being substantially the same distance from the axes of the rollers 20, 22 and 24. As spaced, the outer diameter of the rollers 26 and 20 have a gap of about one-eight to one-quarter of an inch spacing between the opposing peripheries of the rollers. A like spacing is provided between the periphery of the roller 22 and roller 26 and also rollers 22 and 28 with a like spacing for all rollers extending therebelow.

It is to be noted that the tank 15 and the interior components are shown as broken apart since the depth of the tank is dependent upon the process and particularly the time of travel of the film placed within the tank. Often there may be eight, ten or more rollers in each vertical array. In the preferred arrangement a larger roller 32 is provided in the bottom of the center portion of the tank and in alignment with the intermediate or central row of rollers. This larger roller 32 turns in a counterclockwise direction and provides the internal U-shaped guide for the film. Rollers 34, 36 and 38 are the same size as the down rollers or downwardly turning rollers 26, 28 and 30. These rollers preferably are on the same spacing and at the same distance from the top of the tank as are the rollers 26, 28 and 30. Rollers 34, 36 and 38 turn in a clockwise direction and are spaced from the rollers 20, 22 and 24 preferably about the same spacing as the downward travel carrying rollers 20, 26, 28 and 30.

The outer film guide and pathway providing a U-turn of the film is provided by like small rollers carried on common shafts and arranged in a spaced array to provide an intermeshed relationship. As depicted, roller assemblies 40, 42, 44, 46 and 48 carry small rollers that appear on the near side in FIG. 2 and roller assemblies 50, 52, 54 and 56 carry rollers that are positioned and spaced to intermesh with the adjacent roller assemblies. Preferably in a driving arrangement the space between the periphery of the small rollers and the larger rollers 32 is from one-sixteenth to one-eighth of an inch clearance so that the film transport providing the U-shaped path is such that the film as it is formed into the U-shape is closely controlled as possible. As viewed from FIG. 2 all of the rollers are turning in a clockwise direction. In order to make FIG. 3 easy to understand this view shows a more-or-less actual arrangement in which the intermeshed roller shaft assembly 44 is omitted.

Figure 4:
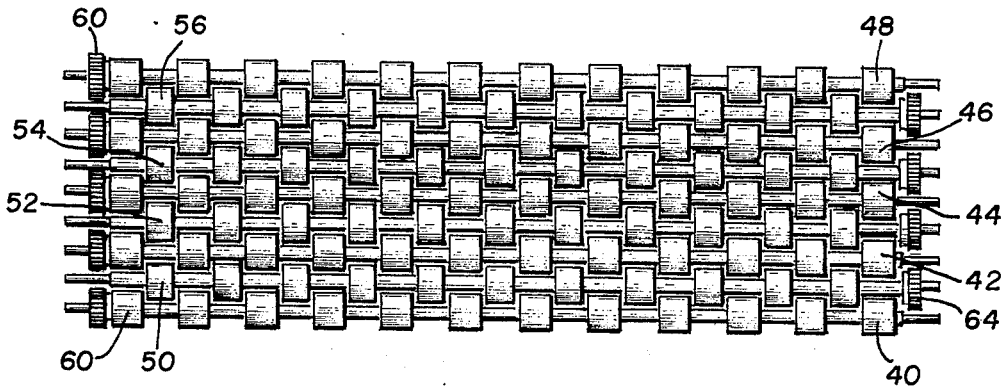
FIG. 4 represents a plan view, partly diagrammatic, of a layout and spacing of the intermeshed small roller assemblies and showing in particular the spacing of the rollers and the gear drive arrangement.
Figure 5:
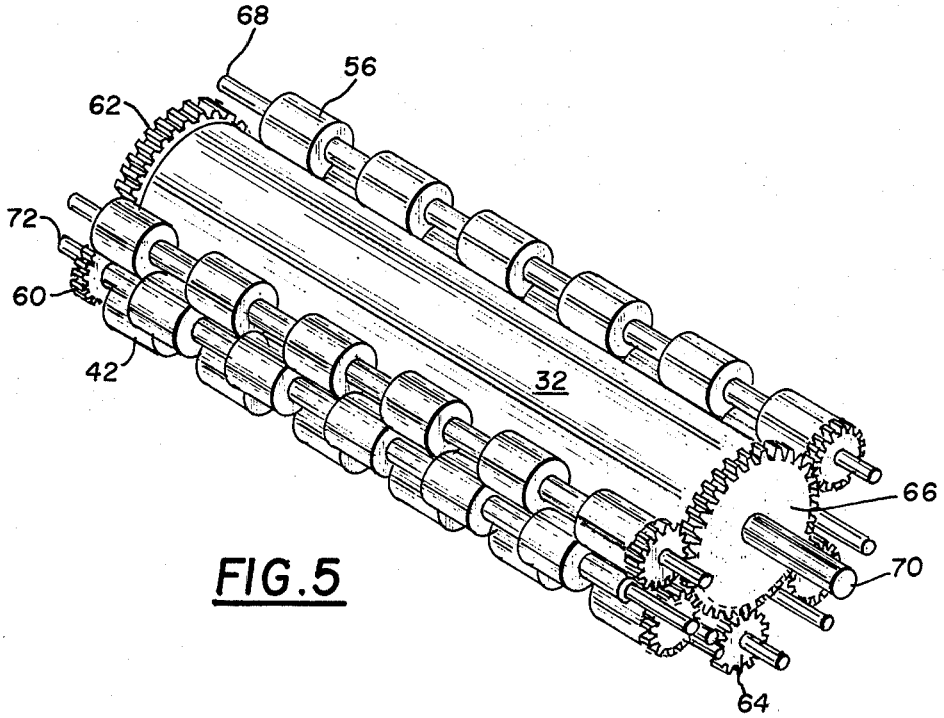
FIG. 5 represents an isometric view of the lower roller assembly providing the U-turn in the processing tank, this view showing the larger inside roller and the grouping of small roller shaft assemblies providing the outside guide, this arrangement showing in particular the intermeshing of the small rollers and a preferred gear drive for the small roller shaft assemblies.

U-Turn Apparatus As Seen in FIGS. 4 and 5

As depicted in FIG. 4, the roller assemblies 40, 42, 44, 46 and 48 have short rollers on each end of the shafts. Roller assemblies 50, 52, 54 and 56 have spaces on each end of the shaft with like sized rollers interspaced so as to fit into the spaces left between the spaced roller segments in the roller shaft assemblies 40, 42, 44, 46 and 48. As seen, the spur gears which drive assemblies 40, 42, 44, 46 and 48 are mounted on the left end of the shaft and like spur gears which drive shaft assemblies 50, 52, 54, 55 and 58 are mounted on the right end of these shaft assemblies.

It is, of course, to be realized that the gears may be carried on the same end with a driving gear or gears made large enough to drive all of these gears. If the gears are carried on the same end they are offset from each other so that they do not mesh with each other. As depicted, the gears driving the roller shaft assemblies are in engagement with only the large drive gear or gears. The length of the rollers and the spacing between the rollers are merely a matter of selection but it is contemplated that the rollers will be approximately an inch to an inch and a half long with appropriate spacing in between so that like sized and like length small rollers in an intermeshed attitude will fit into this provided space.

As depicted in FIGS. 4 and 5, assemblies 40, 42, 44, 46 and 48 have short rollers on both ends of the shaft and the roller assemblies 50, 52, 54 and 56 are intermeshed with and have long shaft portions extending from both ends. The extending portions of shafts for all rollers are carried in bearings mounted in plates or support members, not shown. Also as depicted, roller assemblies 40, 42, 44, 46 and 48 have small spur gears identified as 60 carried on their left end. These gears 60 are all alike since it is contemplated that the rollers are of the same diameter. Gears 60 are driven by a larger spur gear 62 at the left end of roller 32. Gears 64 are mounted on shaft assemblies 50, 52, 54 and 56. These small spur gears 64 are carried and are driven by a large gear 66 carried by the roller 32. For the purpose of identification, shaft 68 is used with intermeshed roller assembly 56 and also a like shaft is used with roller assemblies 50, 52 and 54. On these shafts the gear 64 is carried on the near or right end. Shaft 70 carries the larger intermediate roller 32 and the like gears 62 and 66 on the end of this shaft. Shaft 72 carries the small roller assembly 42 and like shafts are used on roller assemblies 40, 42, 44 and 46 and 48. Gears 60 as carried on these shafts on the far end are in mesh with gear 62. Gears 64 are in mesh with gear 66.

Gear Drive of FIGS. 2, 3, 4 and 5

It is to be noted that as arranged a spur gear carried on and rotated with the shaft and roller 20 drives a gear and shaft associated with roller 26 which in turn drives a gear and shaft associated with roller 22. In a like manner a gear and shaft associated with roller 28 drives a like arrangement associated with roller 24. Similar gears and shafts drive roller 30 which in turn drives roller 32. Roller 32 and shaft 70 carry gears 62 and 66 which in turn drive the several gears 60 and 64 in the manner above-described. The gear carried by roller 22 may also drive the gear and shaft associated with roller 38 and a gear and shaft associated with roller 36. The shaft and gear associated with roller 24 may drive roller 34. The gear and shaft associated with roller 22 may drive the gear and shaft of roller 36. The gear and shaft of roller 20 will drive the gear and shaft of roller 38. The arrangement of the spur gears upon the shafts is merely a matter of selection. The meshing of the spur gears is to be accommodated without engagement or an intermeshing of the gears associated with the vertical rollers in a particular vertical row or array. In other words, the gears associated with rollers 26, 28 and 30 cannot be in mesh nor can the gears associated with rollers 20, 22 and 24, or the row having rollers 34, 36, 38. However, the gears from one vertical row or array are alternately in mesh with another vertical row or array to provide the desired drive. Although depicted in FIGS. 4 and 5 as having gears 60 and 64 on opposite ends of shaft assemblies 40 and 50 and the like, this gear may be moved to the same end and with the drive gear 62 or 66 being similarly moved or made wide enough to accommodate this rearranged gear drive.

Figure 6:
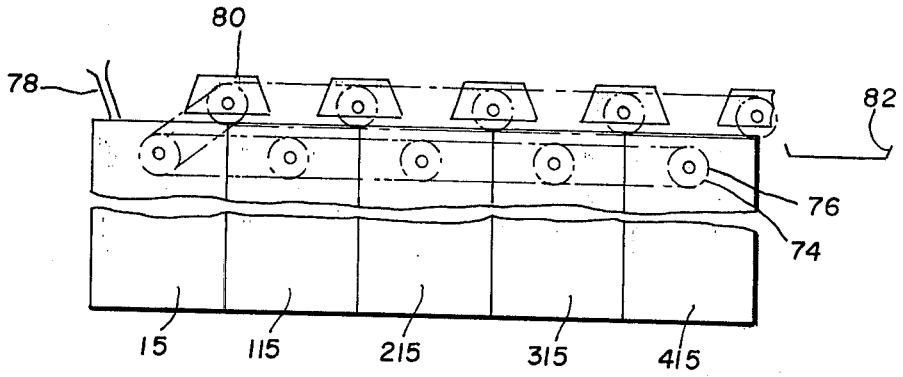
FIG. 6 represents a side view, partly diagrammatic, and showing a side-by-side arrangement of a sequence of developing tanks and possible automatic transfer means from one tank to the next.

Assembly of FIG. 6

It is to be noted that in FIG. 6 a tank 15, as depicted in FIG. 1, may be associated with like tanks 115, 215, 315 and 415 placed side-by-side. A roller chain drive 74 may drive sprockets 76 connected to appropriately positioned larger rollers inside these tanks. An inlet guide 78 may provide the incoming chute for the cut film and upper U-shaped transfer mechanisms 80 may be provided at the top of each of the tanks to provide an automatic transfer required for the redirecting or the directing of the film from one tank to the next adjacent tank. This U-shaped transfer mechanism may be similar to that shown in FIG. 5 or similar to those shown in FIGS. 7 and 8 below with the driver of a roller being moved by the sprockets 76 and/or roller chain 74. After the film has left the last tank 415 it is directed to a receiver 82 which may carry this film to a dryer or to some other film processing operation.

Figure 7:
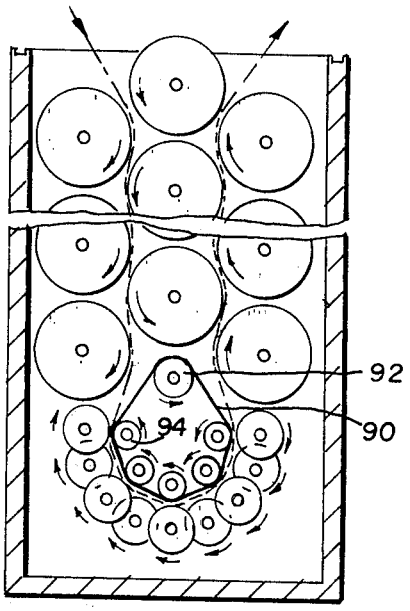
FIG. 7 represents an end view, partly diagrammatic, of a processing tank like that of FIG. 2 but depicting an endless belt apparatus instead of a larger center roller.

Assembly of FIG. 7

In FIG. 7 is shown an alternate construction employing the use of a belt 90 instead of a large roller 32. This belt 90 may be driven by a roller 92 and carried in a round circular path by a plurality of rollers 94 which may be driven or may be free turning idler rollers. Instead of the idler rollers 94, if desired, the belt 90 may be carried by and on a slide. When a slide is provided this may cause the belt to move in a erratic manner so it is preferred that the belt be carried on rollers and driven at a constant indicated speed.

Figure 8:
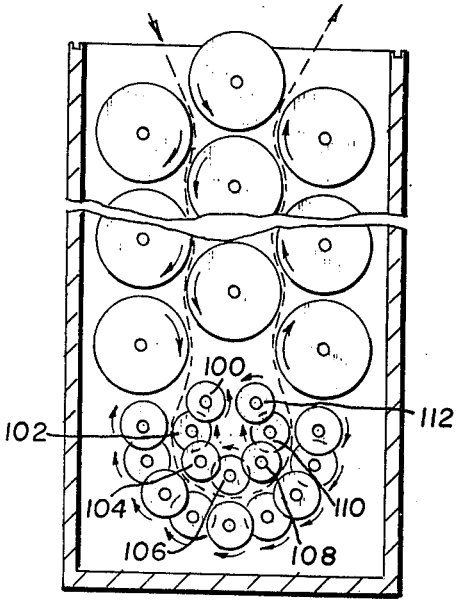
FIG. 8 represents an end view, partly diagrammatic, of a processing tank like that of FIG. 2 but depicting intermeshed small roller assemblies providing the inner guide means as well as the outer U-turn guide.

U-Shaped Transfer of FIG. 8

Referring finally to FIG. 8, it is to be noted that the concept of intermeshing small rollers provided by the outer intermeshed roller assemblies of FIGS. 4 and 5 may be utilized with an inner series of intermeshed inner roller assemblies. These roller shaft assemblies may be fewer in number or smaller in diameter, or both, than the outer guide assembly of FIG. 5. These roller assemblies are spaced and driven so as to give a forward directing continuity to the travel of the film. The peripheries of these short inner rollers are spaced from the outer intermeshed rollers so that at least a sixteenth of an inch spacing is provided between the peripheries of the outer and inner roller shaft assemblies so that no squeezing action of the film occurs. For the sake of identification the intermeshed inner roller assemblies, as viewed in FIG. 8, are numbered 100, 102, 104, 106, 108, 110 and 112 with all turning in the same counterclockwise direction.

In the foregoing description the terms "film" and "film transport" are intended to also include print paper and/or rolls of material which, of course, could be as easily accommodated in roll form as in cut lengths in the above-described apparatus. It is also to be noted that the various U-path apparatus particularly as noted in the description of FIG. 6 may also be utilized to make a U-transfer from one tank to the next. The use of like length small rollers and spacing, as shown in FIGS. 2 and 3, is merely a matter of design preference and does not limit the recitation in the appended claims as it is intended that irregular lengths and spacings are also contemplated.

Terms such as "left," "right," "up," "down," "bottom," "top," "front," "back," "in," "out," "clockwise," "counterclockwise" and the like are applicable to the embodiments shown and described in conjunction with the drawings. These terms are merely for the purpose of description and do not necessarily apply to the position in which the film transfer apparatus may be constructed or used.

While a particular ebodiment of the film transfer apparatus and alternate embodiments have been shown and described it is to be understood the invention is not limited thereto and protection is sought to the broadest extent the prior art allows.

What is claimed is:

1. A transporting apparatus for film, paper and the like providing for an automatic advancement in a U-path through a processing tank of a sheet material of selected size, said path being between powered rollers which are so spaced from each other that no squeezing action occurs when the sheet is passed therebetween, said transport including: (a) a fluid container; (b) at least three vertical rows of rollers with one outside and one middle row defining and providing a downward path of the sheet, this group of rollers offset and driven so that the rollers turn toward one another and downwardly at that portion which is presented to the leading edge of the sheet, the turning rollers so offset that a serpentine path is provided for the sheet and with at least one-eighth of an inch clearance between those rollers providing the downward transport, an upward path provided by the other group of rollers, one outside row and one middle row of rollers providing the upward transport, the rollers offset and driven so that the rollers turn toward one another and upwardly at that portion which is presented to the leading edge of the sheet, these turning rollers also offset so that a serpentine path is provided for the sheet with at least one-eighth of an inch clearance between those rollers providing the upward transport; (c) a redirecting transport assembly provided at the downward terminal of the vertical transport and providing a U-turn path for the sheet and at the end of the U-turn the sheet is discharged to the upward path provided by the vertically arranged rollers, this redirecting transport apparatus including an inner guideway providing a powered transporting surface providing a curved path by which that sheet in contact with the transporting surface is moved forwardly at a determined speed and there is in association with this inner guideway an outer guideway provided by a multiplicity of small rollers arranged in a U-shaped pattern and powered to provide transporting means, the rollers carried in a spaced array and on a common shaft as assemblies, each shaft assembly having a multiplicity of similar small rollers, these assemblies in mounted and driving condition and with the roller assembly on one shaft fitting into the space portions on an adjacent shaft to provide an intermeshed arrangement whereby the driving transport surfaces provided by the intermeshed rollers are approximately one-half the diameter of the small rollers carried on these shafts, the outer small rollers spaced from the inner curved guideway so that at least one-sixteenth of an inch between the inner and outer contact transporting surfaces is maintained; (d) gear driving means carried on and secured on the shafts carrying the rollers so that the rollers are driven at a speed where the film is transported at a selected speed at all positions in the sheet transport, and (e) power transmitting means connected to the shafts of at least one roller to drive all the shafts at selected speeds.

2. A transport apparatus as in claim 1 in which the vertical down and up transporting paths are provided by three rows of larger rollers, the center row of larger rollers being arranged with their axis in a common plane and with the rollers spaced so that their peripheries are close but not in contact with one another, these central rollers all turning in the same direction, the outer rows of rollers arranged so that the axis of the rollers also lay in common planes, the rollers of the outer rows all spaced so that their peripheries are close but not in contact with one another, the outer rollers providing a portion of the downward transport all turning inwardly and downwardly while the outer rollers providing a portion of the upward transport are turning inwardly and upwardly.

3. A transport apparatus as in claim 2 in which the outer rollers are mounted with about the same spacing as the spacing between inner rollers and with the axis of the outer rollers equidistant from the axis of the center rollers.

4. A transport apparatus as in claim 3 in which the positive drive of the vertical rollers is provided by spur gears with a gear carried by a shaft operatively carried by each roller, said gears carried and in meshed driving engagement with a gear carried on a shaft on which is mounted a middle roller which in turn drives a gear carried on the shaft of an outer roller.

5. A transport apparatus as in claim 1 in which the inner guideway of the U-turn path is a large roller.

6. A transport as in claim 5 which the larger lower roller providing the inner guideway is carried on a shaft which has carried on at least one end a spur gear which is driven by a like-pitched gear carried by a shaft carrying an outer roller.

7. A transport as in claim 6 in which the outer guideway providing the U-turn path is a multiplicity of small rollers carried on common shafts, these shafts having a spur gear carried on one end, this gear on the shaft carrying the small roller in mesh and driven engagement with the gear carried on the larger lower roller.

8. A transport as in claim 7 in which the shaft carrying the larger roller has a like spur gear carried on both the near and far end, and with the smaller roller assemblies arranged so that every other shaft carries a gear on the far end and the remaining shaft assemblies carry a driven gear on the near end, the gears on the small roller shaft assemblies that are on the far end being in driven engagement with the gear on the far end of the shaft carrying the larger roller and those small roller shaft assemblies having the gear on the near end are in driven engagement with the gear carried on the near end of the shaft carrying the larger roller.

9. A transport as in claim 1 in which the power transmitting means is provided from an outside power source to an extending shaft from one of the top rollers.

10. A transport as in claim 9 in which the power source is a self-contained motor and the connected roller is the top central roller.

11. A transmitting apparatus for film, paper and rolls and the like and providing for an automatically advanced sheet in a U-path through and from a tank of selected size, said path being downward and upward with no squeezing action on the sheet material, said transport including: (a) a redirecting sheet transport assembly provided at the terminal end of a first transport path and when the sheet material has entered this redirecting transport a U-turn path is provided and at the end of this U-turn path the sheet material is discharged to a second path, this redirecting transport apparatus including an inner guideway providing a powered transporting surface and providing a curved path by which that sheet material in contact with the transporting surface is moved forwardly at a determined speed and there is in association with this inner guideway an outer guideway provided by a multiplicity of small rollers arranged in a U-shaped pattern and powered to provide transporting means, the rollers carried in a spaced array and on a common shaft as assemblies, each shaft assembly having a multiplicity of similar small rollers, these assemblies in mounted and driving condition having the roller assembly on one shaft fitting into the space portions on an adjacent shaft to provide an intermeshed arrangement whereby the driving transport surfaces provided by the intermeshed rollers are approximately one-half the diameter of the small rollers carried on these shafts, the outer small rollers spaced from the inner curved guideway so that at least one-sixteenth of an inch between the inner and outer contact transporting surfaces is maintained, (b) gear driving means carried on and secured on the shafts carrying the rollers so that the rollers are driven at a speed where the sheet material is transported at a selected speed at all positions in this U-turn transport apparatus, and (c) power transmitting means connected to the shafts of at least one roller to drive all the shafts at selected speeds.

12. A transport apparatus as in claim 11 in which the inner guideway of the U-turn path is a large roller.

13. A transport as in claim 12 in which the large lower roller providing the inner guideway is carried on a shaft which has carried on at least one end a spur gear which is driven by a like-pitched gear carried by a shaft which is associated with the vertical transport.

14. A transport as in claim 13 in which the outer guideway providing the U-turn path is a multiplicity of small rollers carried on common shafts, these shafts having a spur gear carried on one end, this gear on the shaft carrying the small roller in mesh and driven engagement with the gear carried on the larger lower roller.

15. A transport as in claim 14 in which the shaft carrying the larger roller has a like spur gear carried on both the near and far end, and with the smaller roller assemblies arranged so that every other shaft carries a gear on the far end and the remaining shaft assemblies carry a driven gear on the near end, the gears on the small roller shaft assemblies that are on the far end being in driven engagement with the gear on the far end of the shaft carrying the larger roller and those small roller shaft assemblies having the gear on the near end are in driven engagement with the gear carried on the near end of the shaft carrying the larger roller.

16. A transport apparatus as in claim 11 in which the inner guideway of the U-turn path is provided by an endless belt carried on a support means and traveling in a curved path when and while opposite the multiplicity of small rollers.

17. A transport apparatus as in claim 11 in which the inner guideway of the U-turn path is provided by a multiplicity of small rollers arranged in a U-shaped pattern and powered to provide transporting means, the rollers carried in a spaced array and on a common shaft as assemblies, each shaft assembly having a multiplicity of similar small rollers, these assemblies in mounted and driving condition having the roller assembly on one shaft fitting into the spaced portions on an adjacent shaft to provide an intermeshed arrangement whereby the driving transport surfaces provided by the intermeshed rollers are approximately one-half the diameter of the small rollers carried on these shafts, the inner small rollers spaced from the outer small rollers providing the outer guideway so that at least one-sixteenth of an inch between the inner and outer contact transporting surfaces is maintained.

* * * * *